US007424870B2

(12) United States Patent
Odoni et al.

(10) Patent No.: US 7,424,870 B2
(45) Date of Patent: Sep. 16, 2008

(54) COMBUSTION-ENGINED SETTING TOOL

(75) Inventors: Walter Odoni, Planken (LI); Ulrich Schiestl, Feldkirch (AT)

(73) Assignee: Hilti Aktiengesellschaft, Schaan (LI)

( * ) Notice: Subject to any disclaimer, the term of this patent is extended or adjusted under 35 U.S.C. 154(b) by 38 days.

(21) Appl. No.: 11/543,769

(22) Filed: Oct. 4, 2006

(65) Prior Publication Data

US 2007/0074684 A1 Apr. 5, 2007

(30) Foreign Application Priority Data

Oct. 5, 2005 (DE) ..... 10 2005 000 134

(51) Int. Cl.
*F02B 71/00* (2006.01)

(52) U.S. Cl. ..... 123/46 SC; 123/46 H; 227/10

(58) Field of Classification Search ..... 123/46 SC, 123/46 H; 227/10
See application file for complete search history.

(56) References Cited

U.S. PATENT DOCUMENTS

| | | | |
|---|---|---|---|
| 3,967,771 | A | 7/1976 | Smith |
| 4,403,722 | A | 9/1983 | Nikolich |
| 6,123,242 | A | 9/2000 | Kersten |
| 6,220,495 | B1 | 4/2001 | Jakob |
| 2004/0104258 | A1 | 6/2004 | Favre-Bulle |

*Primary Examiner*—Noah Kamen
(74) *Attorney, Agent, or Firm*—Abelman, Frayne & Schwab

(57) ABSTRACT

A combustion-engined setting tool for driving fastening elements such as, e.g., nails, bolts, pins in a constructional component includes a combustion chamber (13) for combusting an oxidant-fuel mixture, elements for closing the inlet opening (15) and the outlet opening (19) provided in the combustion chamber, ventilator (41) for generating a gas flow from the inlet opening through the combustion chamber and toward the outlet opening (19), and a combustion-energy driven drive unit (42) for driving the ventilator.

8 Claims, 5 Drawing Sheets

COMBUSTION-ENGINED SETTING TOOL

BACKGROUND OF THE INVENTION

1. Field of the Invention

The present invention relates to a combustion-engined setting tool for driving fastening elements in a constructional component and including a combustion chamber for combusting an oxidant-fuel mixture and having an inlet opening means and an outlet opening means for closing the inlet opening and the outlet opening of the combustion chamber, and a ventilator for generating a gas flow from the inlet opening through the combustion chamber and toward the outlet opening.

2. Description of the Prior Art

Setting tools of the type described above have a combustion chamber in which a portion of the liquefied gas or another evaporated fuel is combusted, together with an oxidant such as, e.g., environmental air. In order to obtain as high as possible driving energy, it is important to evacuate flue gases out of the combustion space or the combustion chamber as completely as possible. To this end, according to the state of the art, e.g., ventilators are used, with which, after completion of a setting process, fresh air moves through the combustion chamber in order to rinse it.

U.S. Pat. No. 4,403,722 discloses a combustion-engined setting tool having a combustion chamber for combusting a mixture of air and fuel gas and a ventilator arranged on the rear wall of the combustion chamber. The ventilator is driven by an electric motor that is supplied with electrical energy from batteries. The batteries are located in a holder which extends parallel to the nail receptacle in a magazine.

The drawback of this setting tool consists in that the setting tool has an increased weight due to the necessity to carry the necessary batteries or accumulator. The other drawback consists in the need to replace the battery when the electrical energy stored therein is exhausted.

Accordingly, an object of the present invention is to provide a setting tool of the type described above and in which the above-mentioned drawbacks are eliminated.

Another object of the present invention is to provide a setting tool of the type described above and in which aeration of the combustion chamber is effected in a simple manner.

SUMMARY OF THE INVENTION

These and other objects of the present invention, which will become apparent hereinafter, are achieved by providing in the setting tool, a combustion energy-driven drive unit for driving the ventilator. The combustion energy-driven drive unit uses the combustion energy of the setting tool, directly or indirectly, as the drive energy for the ventilator. As a result, the batteries for the electric motor can be dispensed with, which insures a noticeable reduction of the tool weight, and the need to replace the batteries is eliminated.

Advantageously, the combustion energy-driven drive unit comprises an energy accumulator for storing mechanical energy generated by the combustion energy and having output thereof connected with the ventilator. With the energy accumulator, it is possible to store the drive energy for the ventilator and to extract and use it at a later date. Therefore, the ventilator needs not to be driven when the combustion energy is released, i.e., during the setting process. The stored energy can be used after the end of the setting process or before the start of the setting process.

Advantageously, the energy accumulator has a storage capacity for storing more energy than generated by a single combustion process. Thereby, the ventilator can also be driven when during the setting process, because of poor combustion, e.g., when the reserve of the fuel gas has declined, not enough energy can be transmitted from the piston to the ventilator. The energy accumulator permits to compensate this deficit and insures a complete rinsing of the combustion chamber with fresh air.

According to a technically simple embodiment of the invention, the energy accumulator is formed as a spring such as, e.g., scroll spring, spiral spring, leaf spring, elastomeric spring or the like. Thereby, several springs can be used as the energy accumulator for increasing the storage capacity of the energy accumulator.

It is further advantageous when the energy accumulator forms part of an energy storage unit formed as a clockwork drive. As a clockwork drive, a mechanism is understood that in addition to the energy accumulator includes a device for loading the energy accumulator by rotation of an input member, and a device for, e.g., if necessary, a switchable release of the store energy via an output member. These devices may have one or more idle gear(s) and or gear transmission for reduction or increase of the ratio of the output movement. The device for the switchable release of the stored energy can be provided with a mechanism that enables to operate the output or the take-off of the clockwork drive for a predetermined time period in accordance with the switching instruction. Upon expiration of the predetermined time period, the clockwork drive is automatically switched off. In this way, the ventilator can be operated for a predetermined time period.

Advantageously, the combustion energy-driven drive unit comprises a cylinder communicating with the combustion chamber, and a piston displaceable in the cylinder. With the combustion energy-driven drive unit, the stroke movement of the piston can be easily converted in a rotational movement of the ventilator. Thus, this constructive solution is non-expensive. The piston can be formed by the setting piston of the setting toll or be formed by a displaceable rear wall of the combustion chamber.

Advantageously, a spring supports the piston against an end of the cylinder remote from the combustion chamber. In this way, the piston can be easily displaced into its initial position. This spring can also be used as an energy accumulator.

It is further advantageous when on the piston, there is arranged transmission member for transmitting the stroke movement of the piston to the input member or the energy accumulator, for converting the stroke movement into the rotary movement. According to a constructively simple solution, the transmission member is formed as a rack, and the input member is formed as a gear wheel.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
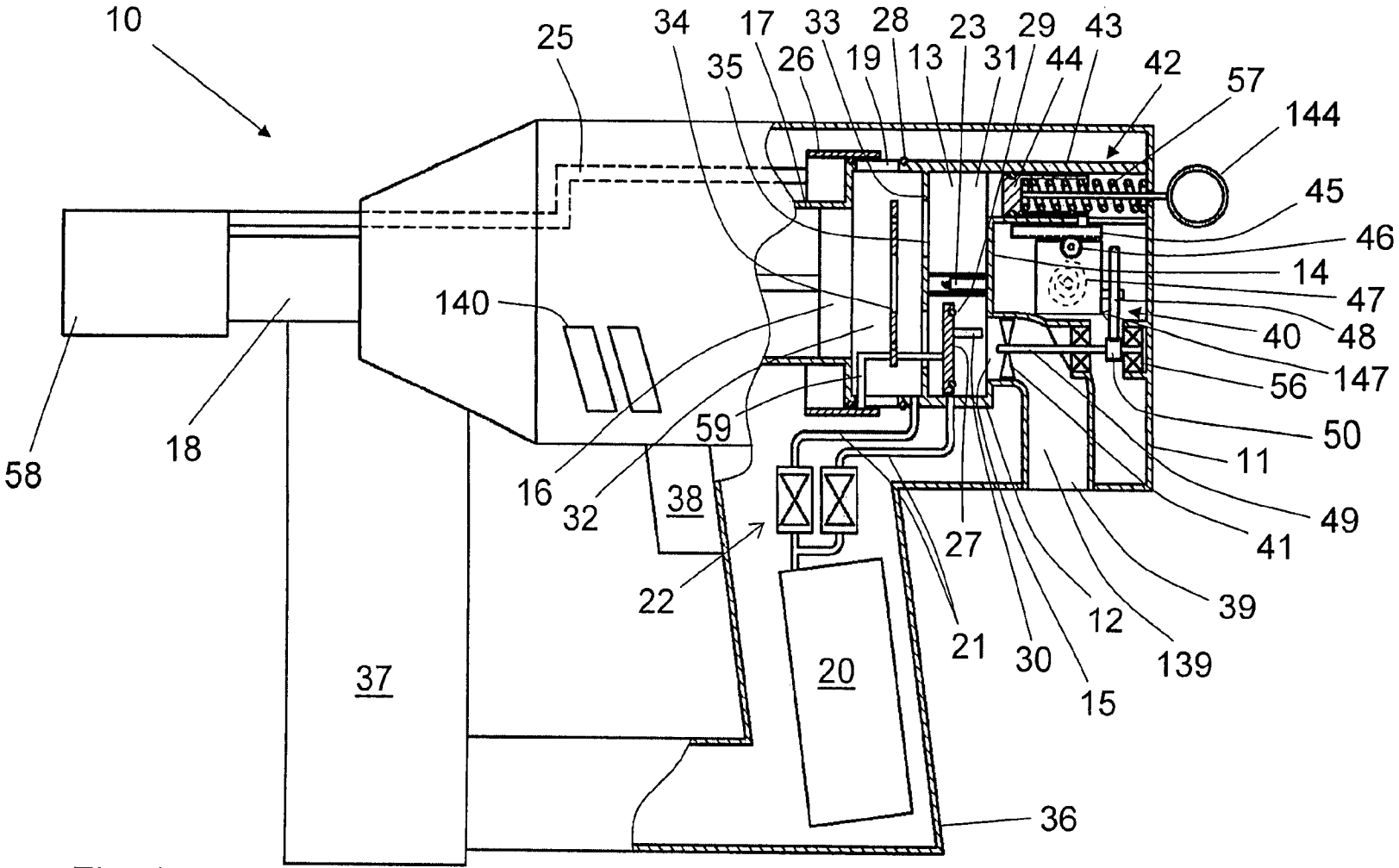
FIG. 1 a partially cross-sectional side view of a setting tool according to the present invention in a rest position.
Figure 2:
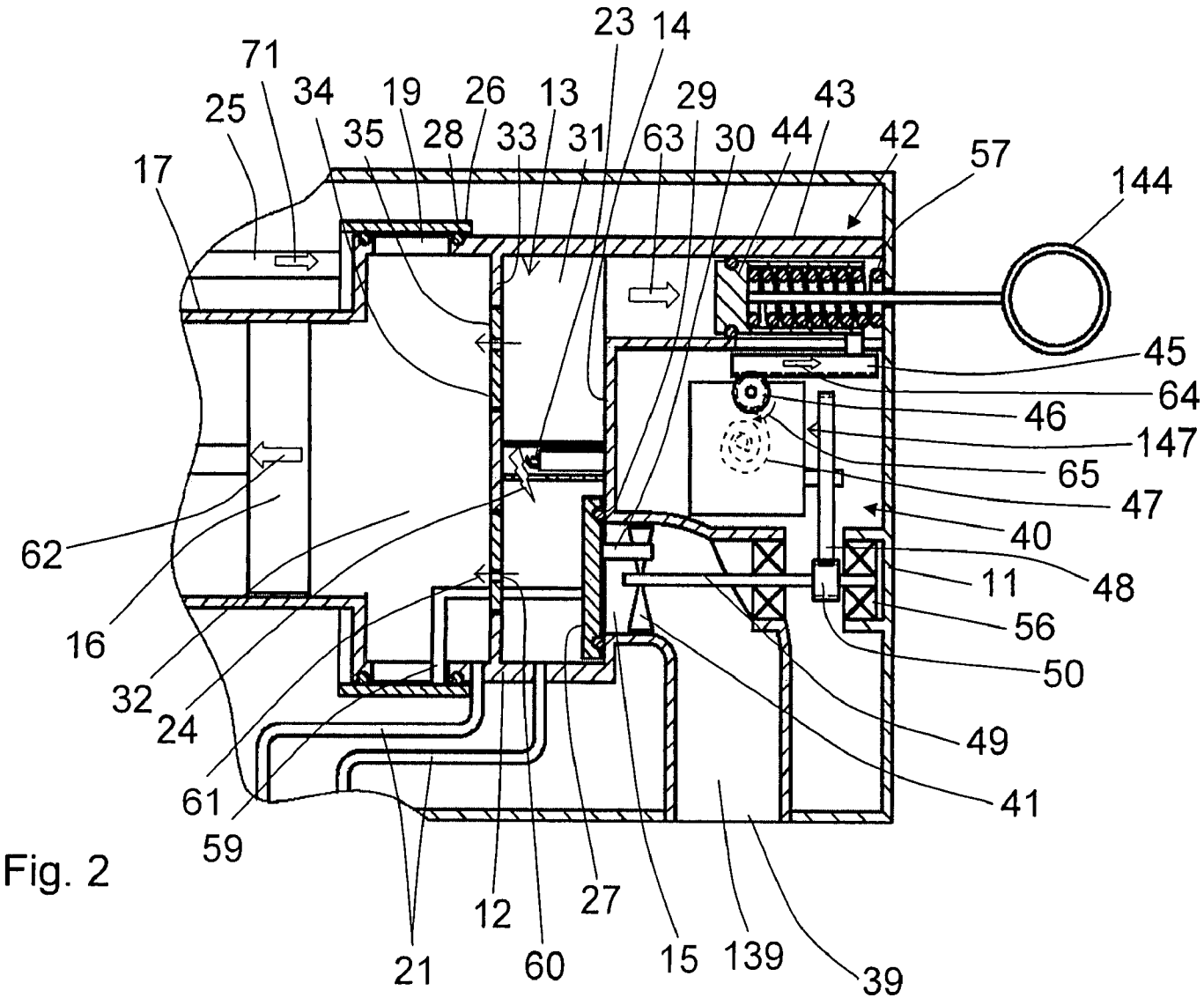
FIG. 2 a partial cross-sectional view of the setting tool shown in FIG. 1 in a position in which the setting tool is pressed against a constructional component and the switch is actuated.
Figure 3:
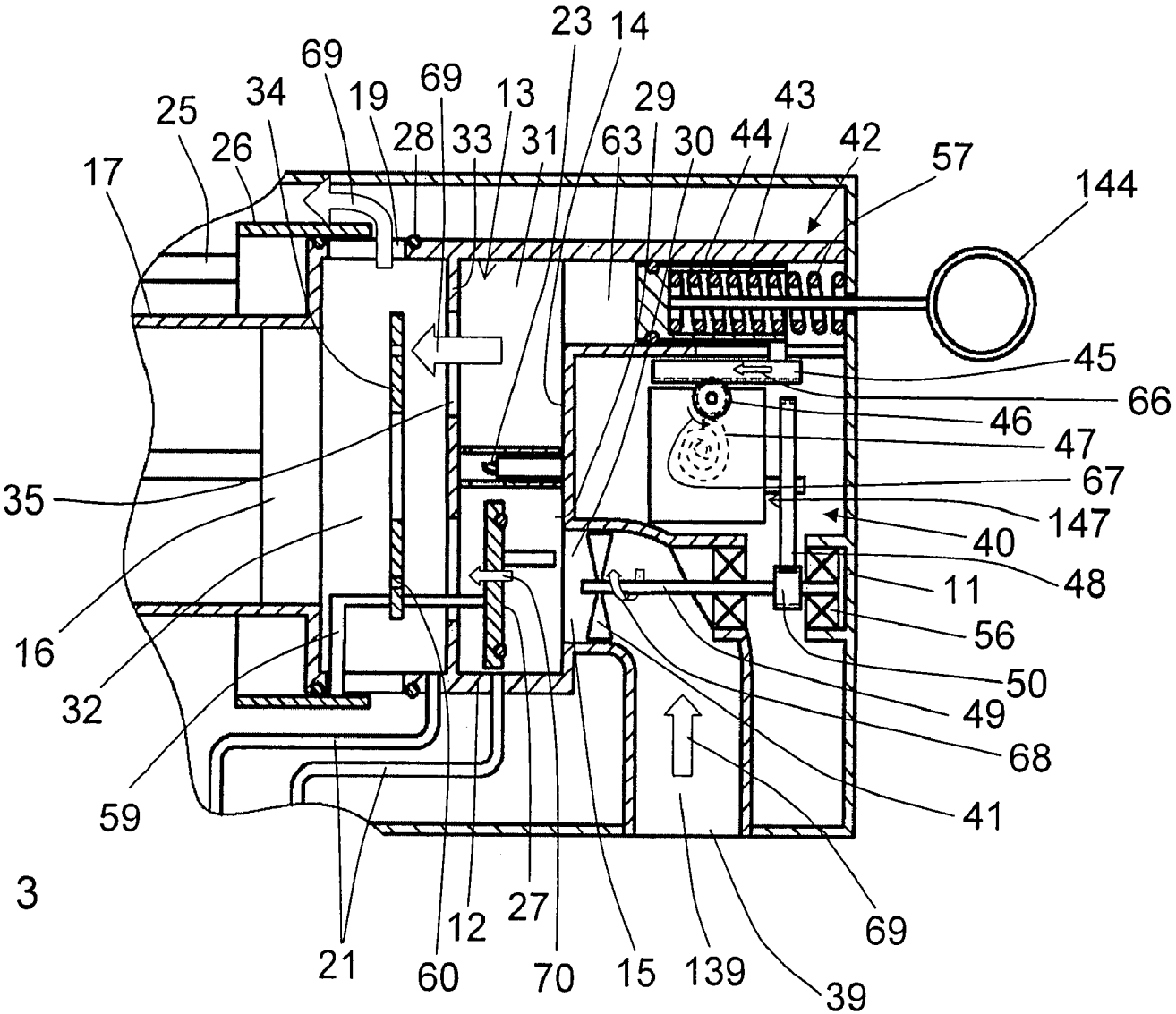
FIG. 3 a partial cross-sectional view of the setting tool shown in FIG. 1 in a position in which the setting tool is lifted off the constructional component.

A hand-held, combustion-engined setting tool 10 according to the present invention, which is shown in FIGS. 1-3, is driven by liquid or gaseous fuel.

FIG. 1 shows the setting tool 10 in its initial or non-operative position. The setting tool 10 has a housing 11 in which there is arranged a setting mechanism with which a fastening element such as a nail, bolt or the like is driven in a constructional component when the setting tool 10 is pressed against the constructional component and is actuated.

The setting mechanism includes, among others, a combustion chamber 13 provided in a combustion chamber housing 12, a piston guide 17 in which a setting piston 16 is displaceably supported, and a bolt guide 18 in which a fastening element is displaceable. The fastening element is displaced by a forward-movable, setting direction end of the setting piston 16 and, thereby, can be driven in a constructional component. The fastening elements can be stored, e.g., in a magazine 37 provided on the setting tool 10.

The combustion chamber housing 12 is fixedly connected with the piston guide 17 and has at its end adjacent to the piston guide 17 at least one outlet opening 19. Outside of the combustion chamber housing 12, first closing means 26, which is formed as a sleeve, is axially displaceable over the combustion chamber housing 12. The closing means 26 closes the outlet opening 19. For a complete sealing of the outlet opening 19 relative to the first closing means 26, there is provided a sealing member 28 formed, e.g., as an O-ring. The closing means 26 is connected with a press-on string 25 in form of a press-on bar. The press-on string 26 is connected with a press-on feeler 58 displaceable over the bolt guide 18.

At the end of the combustion chamber housing 12 remote from the piston guide 17, there is provided a rear wall 14 of the combustion chamber 13 and in which an inlet opening 15, which is connected with an air inlet 39 of the housing 11, is formed. The inlet opening 15 can be closed with second closing means 27 formed as a closing plate. The second closing means 27 is likewise connected with the press-on string 25. For a complete sealing of the inlet opening 15 relative to the second closing means 27, there is provided a sealing member 29 formed, e.g., as an O-ring.

In the embodiment shown in FIGS. 1-3, the combustion chamber 13 is divided by a separation wall 33 in a first sub-chamber 31 and a second sub-chamber 32. An ignition unit 23 for ignition of an air fuel mixture that fills the combustion chamber 13, is provided only in the first sub-chamber 31. In the separation wall 33, there is provided a ring-shaped opening 35 into which a ring-shaped plate 34, which is provided with a plurality of through-openings 60, can be displaced by the press-on string 25. To this end, the ring-shaped plate 34 is arranged on a support member 59 connected with the press-on string 25. The support member 59 also carries the second closing means 27.

A fuel feeding conduit 21 feeds fuel into the combustion chamber 13 from a fuel reservoir 20, e.g., a liquefied gas can. In the fuel feeding conduit 21, there is provided a metering device which is generally designated with a reference numeral 22. The metering device 22 can have, e.g., two metering valves for separately metering fuel into each of the sub-chambers 31, 32. The control or actuation of the metering device 22 can be effected with the press-on string 25, an actuation switch 38 provided on the on the handle 36 of the setting tool 10, or the metering device 22 can be controlled by a control device not shown in the drawings.

The setting tool 10 further includes a ventilation device generally designated with a reference numeral 40 that includes a ventilator 41 driven by a combustion-energy driven drive unit 42. The ventilator 41 is arranged in a channel 139 that connects the inlet opening 15 with the air inlet 39. The ventilator 41 is supported on a shaft 49 that is rotatably supported in a pivot bearing 56. The combustion energy-driven drive unit 42 includes a piston 44 displaceable in a cylinder 43. The piston 44 is supported by a spring 57 against an end of the cylinder 43 remote form the combustion chamber 13. The opposite end of the cylinder 43 opens into the combustion chamber 13.

The combustion energy-driven drive unit 42 further has an energy storage unit 147 that is formed as a clockwork drive and that includes an energy accumulator 47 formed as a scroll spring which is shown in the drawings with dash lines.

The energy storage unit 147 includes an input member 46 that is formed as a gear wheel cooperating with a transmission member 45 formed as a rack and connected with the piston 44. Upon displacement of the piston 44, its stroke movement in the direction of spring 57 is transmitted by the transmission member 4 and the input member 46, which cooperates with the transmission member 45, to the energy storage unit 147 and thereby to the energy accumulator 47. The energy storage unit 147 further has a rotatably supported driven member 48 that is formed as a gear wheel that can release the energy, which is accumulated by the energy accumulator 47, in form of rotational energy. The driven member 48 is connected with the shaft 49 and thereby, with the ventilator 41 by an input wheel 50 likewise formed as a gear wheel. In addition to the shown transmission between the driven member 48 and the input wheel 50, a further gear transmission, not shown in the drawings, can be provided between the energy accumulator 47 and the driven member 48.

On the second closing means 27, there is provided a pin-shaped blocking element 30 facing the ventilator 41. This blocking element 30 can stop rotation of the ventilator 41 when the blocking element 30 projects, as shown in FIG. 2, between the rotor blades of the ventilator 41.

FIG. 2 shows a position in which the setting tool 10 is pressed with the press-on feeler 58, which is shown in FIG. 1, against a constructional component, whereby the press-on string 25 is displaced in the direction of arrow 71 toward the combustion chamber 13. Thereby, the inlet opening 15 becomes closed with the second closing means 27 and the outlet opening 19 becomes closed with the first closing means 26. The blocking element 30 projects between the rotor blades of the ventilator 41. Further, a ring-shaped plate 34 is displaced into the ring-shaped opening 35 of the separation wall 33. By actuating the actuation switch 38 (shown in FIG. 1), the ignition unit 23 is actuated, and ignition 24 of the air-fuel mixture, which fills the combustion chamber 13, takes place. The combustion spreads through the through-opening 60 in the separation wall 33 or in the ring-shaped plate 34 from the first sub-chamber 31 into the second sub-chamber 32 (in the direction of arrow 61) and generates in this way a turbulence within the burning gases and which is necessary for an efficient combustion. The expanding combustion gases displace the setting piston 16 in a setting direction 62. Due to the opening of the cylinder 43 into the combustion chamber 13, the piston 44, which is likewise subjected to the action of the combusted gases, would be displaced in the direction of arrow 63 against the spring 57 that supports the piston 44. This also causes displacement of the transmission member 45. The displacement of the transmission member 46 causes rotation of the input member 46 in the direction of arrow 65. Thereby, energy storage unit 147, which is formed as a clockwork drive, is wound up, and the energy accumulator 47, which is formed as a scroll spring, is tightened. Simultaneously, due to the rotation of the input member 46, the driven member 48 of the energy accumulator 47 becomes unblocked. However, the rotation of the driven member 48 is prevented by the blocking element 30 that blocks the ventilator 41.

In FIG. 3, the setting tool 10 is lifted off the constructional component. Thereby, both the outlet opening 19 and the inlet opening 15 becomes open. The return of the press-on string 25 to its initial position and the displacement of the first and second closing means 26, 27 in the direction of arrow 70 can be effected by a spring, not shown.

The blocking element 30 is displaced in the direction of arrow 70, together with the second closing means 27. Thereby, the ventilator 41 becomes released and is rotated, in the direction of arrow 68 by the driven member 48 of the energy storage device 147 which cooperates with the input member 50 that is supported on the shaft 49 on which the ventilator 41 is also supported. As a result of rotation of the ventilator 41, air flows from the air inlet 39 into the combustion chamber 13 and further through the outlet opening 19 to exhaust openings 140 (FIG. 1) in the housing 11. With the air stream, the combustion gases, which still remain in the combustion chamber 13, are released into environment.

The ventilator 41 is rotated by the energy storage device 147 for a certain time predetermined in the energy storage device 147. Then, the energy storage device 147 locks the driving element 48 until the input member 46 is again rotated in the direction of arrow 65.

After opening of the outlet opening 19 and the inlet opening 15, the piston 44 is again displaced in its initial position shown in FIGS. 1-2. With the displacement of the piston 44 to its initial position, the input member 45, which is displaced together with the piston 44 in the direction of arrow 66, rotates in the input member 46 in the direction of arrow 67, whereby the input member 46 is in a free running state in this direction.

In order to preload or tighten the energy accumulator 47 of the energy storage device 147 before the first start of the setting tool 10, the combustion energy-operated drive unit 42 is provided with a manually operated handle 144 that displaces the piston 44. However, instead of engaging the piston 44, this handle can be, e.g., connected directly with the input member 46 for actuating same.

Alternatively to the foregoing solution, the spring 57 can be used as an energy accumulator. Then, instead of the energy storage device 147, there would be provided a gear transmission between the transmission member 45 and the ventilator 41, whereby the free running state of the input member 46 would exist in the rotational direction shown with the arrow 65 (FIG. 2). Upon the return displacement of the piston 44 in the direction of arrow 66 (FIG. 3), the gear transmission, together with the input member 46 and the driven member 48, which is supported on the same shaft 49 as the ventilator 41, would be driven by the spring 57 as soon as the blocking element 30 releases the ventilator 41. In order to provide for a subsequent rotation of the ventilator 41 on the shaft 49 after switching off the energy storage device 147, the input wheel 50 can be so formed as to provide a free running state of the shaft 49.

Figure 4:
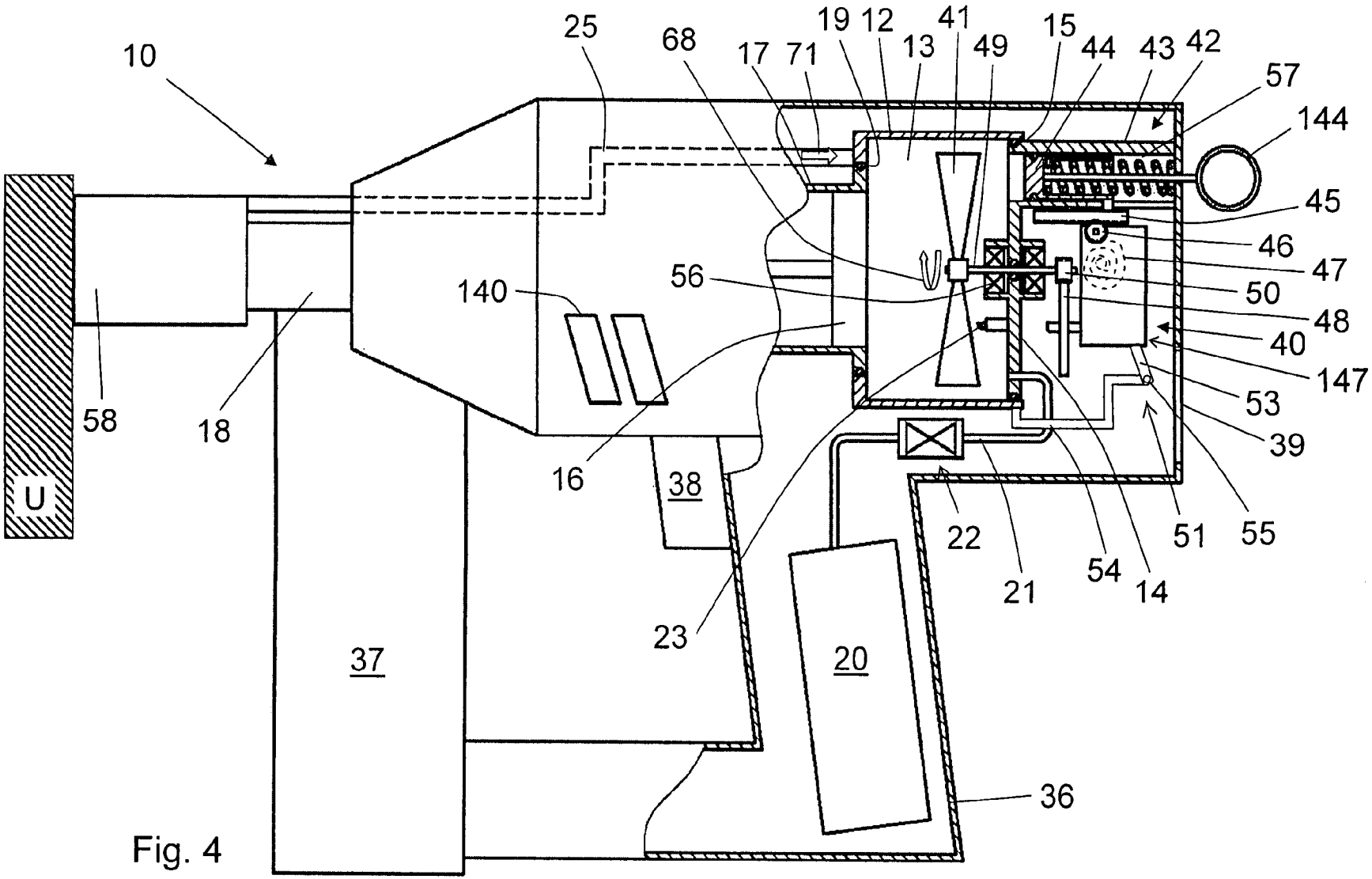
FIG. 4 a partially cross-sectional side view of another embodiment of a setting tool according to the present invention in a position in which the setting tool is completely pressed against a constructional component.
Figure 5:
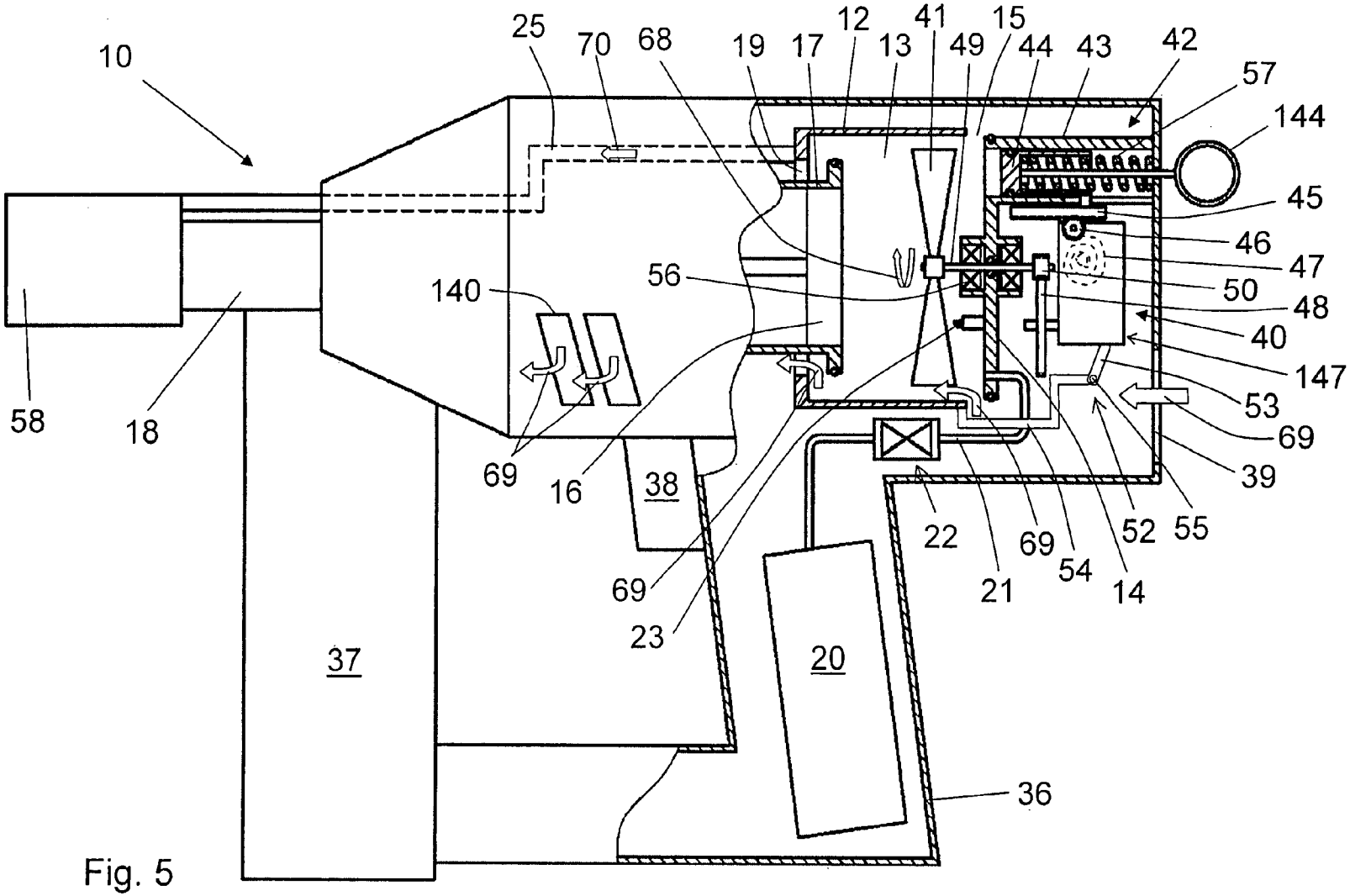
FIG. 5 a view similar to that of FIG. 4 but in a position of the setting tool in which it is lifted off the constructional component.

A hand-held, combustion-engined setting tool 10, which is shown in FIGS. 4-5, differs from that shown in FIGS. 1-3, in that the combustion chamber housing 12 is formed as a sleeve and is displaceable relative to the piston guide 17. The press-on string 25, which is formed as a rod, engages with one of its end the combustion chamber 12. The opposite end of the press-on string 25 is connected with the press-on feeler 58.

The ventilator 41 is arranged in the combustion chamber 13, and the shaft 49, on which the ventilator 41 is supported, is itself supported in a pivot bearing 56 provide don the rear wall 14 of the combustion chamber 14. The metering device 22 has only one metering valve, and the combustion chamber 13 is not divided.

The combustion energy-driven drive unit 42 corresponds essentially to that shown in FIGS. 1-3. The only difference consists in that the energy storage device 147 is equipped with a switch 53 that is actuated by the driven member 48. The switch 53 is formed as an adjusting lever that is connected with a switch rod 54 at an articulation point 55. The switch rod 54 is fixedly connected to the combustion chamber housing 12.

In the position shown in FIG. 4, the setting tool 10 is already pressed against a constructional component, with the press-on string 25 having been displaced in the direction of arrow 71. Together with the press-on string 25, the combustion chamber housing 12 or the combustion chamber sleeve has also been displaced in the direction of arrow 71, resulting in closure of the outlet opening 19 and the inlet opening 15. The switch 53 likewise has been pivoted in the direction of the arrow 71 in its first position 51, whereby the driven member 48 of the energy storage device has been activated. With the rotation of the driven member 48, its rotation is transmitted by the input gear 50 to the shaft 49 carrying the ventilator 41 and rotatable in the direction of the arrow 68. The rotation of the ventilator 41 causes a turbulent flow condition in the combustion chamber 13, whereby the energy effect is increased upon ignition and combustion of the air-fuel mixture filling the combustion chamber 13. The ventilator 41 can be driven, as it has already been discussed above, for a predetermined time period, with the energy storage unit 147 being turned off automatically after the expiration of the predetermined time period. The energy storage unit 147 is also turned off upon actuation of the actuation switch 38. This can take place by a switch, not shown, of the energy storage device 147 and which is connected with the actuation switch 38.

FIG. 5 shows the position of the setting tool 10 after it has been lifted off the constructional component upon completion of the setting process. In the position shown in FIG. 5, the combustion chamber housing 12 or the combustion chamber sleeve has been displaced, together with the press-on string 25, in the direction of arrow 70, whereby the outlet opening 19 and the inlet opening 15 became open. The displacement of the press-on string 25 and the combustion chamber housing 12 in the direction of the arrow 70 can be effected, e.g., by a spring, not shown. Together with the combustion chamber housing 12, also the switch rod 54 is displaced in the direction of arrow 70, and the switch 53 is displaced in its second position 52, which again actuates the driven member 48 of the energy storage unit 147. The driven member 48 is rotated, with its rotation begin transmitted by the input wheel 50 to the shaft 49 which carries the ventilator 41 and is rotated now in the direction of the arrow 68. The rotation of the ventilator 41 causes an air flow from the air inlet 39 into the combustion chamber 13 and further through the outlet opening 19 to the exhaust openings 140 in the housing 11. With the air flow, the combustion gases, which still remain in the combustion chamber 13, are released into the environment. The energy storage unit 147 rotates the ventilator 41 for a predetermined period of time which is predetermined in the energy storage unit. Then, the energy storage unit 147 locks the driven member 48 again until the switch 53 is displaced anew in its first position 51.

With respect to other not mentioned elements and functions, the reference is made to the description with reference to FIGS. 1-3 in its entirety.

Though the present invention was shown and described with references to the preferred embodiments, such are merely illustrative of the present invention and are not to be construed as a limitation thereof and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A combustion-engined setting tool for driving fastening elements in a constructional component, comprising:

a combustion chamber (13) for combusting an oxidant-fuel mixture for generating combustion energy for driving the setting tool and having an inlet opening (15) and an outlet opening (19);

means (26, 27) for closing the inlet opening (15) and the outlet opening (19);

ventilator means (41) for generating a gas flow from the inlet opening through the combustion chamber (13) and toward the outlet opening (19); and a combustion-energy driven drive unit (42) for driving the ventilator means (41) and including an energy accumulator (47) for storing mechanical energy generated by the combustion energy and having an output thereof connected with the ventilator means (41).

2. A setting tool according to claim 1, wherein the energy accumulator (47) has a storage capacity for storing more energy than generated by one combustion process.

3. A setting tool according to claim 1, wherein the energy accumulator (47) is formed as a spring.

4. A setting tool according to claim 1, wherein the energy accumulator (47) forms part of an energy storage unit (147) that is formed as a clockwork drive.

5. A setting tool according to claim 1, wherein the combustion energy-driven drive unit (42) comprises a cylinder (43) communicating with the combustion chamber (13), and a piston (44) displaceable in the cylinder (43).

6. A setting tool according to claim 5, further comprising a spring (57) that supports the piston (44) against an end of the cylinder (43) remote from the combustion chamber (13).

7. A setting tool according to claim 5, further comprising a transmission member (45) arranged on the piston (44) for transmitting a stroke movement o the piston (44) to an input member (46) of the energy accumulator (47).

8. A setting tool according to claim 7, wherein the transmission member (45) is formed as a rack, and the input member (46) is formed as a gear wheel.

* * * * *